US005654105A

United States Patent [19]

Obringer et al.

[11] Patent Number: 5,654,105

[45] Date of Patent: Aug. 5, 1997

[54] MULTI-LAYER THERMALLY TRANSFERABLE PRINTING RIBBONS

[75] Inventors: Thomas J. Obringer, Vandalia; John C. Rosenbaum, Dayton; Michael W. Olmstead, West Carrollton, all of Ohio

[73] Assignee: NCR Corporation, Dayton, Ohio

[21] Appl. No.: 519,581

[22] Filed: Aug. 25, 1995

[51] Int. Cl.[6] ..... B41M 5/26

[52] U.S. Cl. ..... 428/483; 428/195; 428/484; 428/488.1; 428/500; 428/522; 428/690; 428/913; 428/914

[58] Field of Search ..... 428/195, 484, 428/488.1, 488.4, 480, 500, 522, 207, 690, 483, 913, 914

[56] References Cited

U.S. PATENT DOCUMENTS 4,880,324 11/1989 Sato et al. ..... 428/488.4

5,389,429 2/1995 Takizawa et al. ..... 428/195

*Primary Examiner*—Pamela R. Schwartz

*Attorney, Agent, or Firm*—Craig E. Miller

[57] ABSTRACT

Multi-layer thermally transferable printing ribbons and methods of making the same consisting of elongated backing elements having a subcoat layer requiring a relatively high level of thermal energy to transfer the subcoat layer and a topcoat layer which requires a lower level of thermal energy to transfer the topcoat layer. Accordingly, when printing using a lower level of thermal energy, only the topcoat layer will transfer onto the paper or other print receiving medium. On the other hand, if a relatively high level of thermal energy is used, both the topcoat layer and the subcoat layer will transfer onto the paper or other print receiving medium, with the subcoat layer remaining on top and blocking or obscuring the topcoat layer.

6 Claims, 2 Drawing Sheets

MULTI-LAYER THERMALLY TRANSFERABLE PRINTING RIBBONS

BACKGROUND AND SUMMARY OF THE INVENTION

The present invention relates generally to new and novel improvements in thermally transferable printing ribbons and methods of making the same. More particularly, the present invention relates to multi-layer thermally transferable printing ribbons and methods of making the same which permit users to print, for example, a black bar code image and a clear fluorescent image on the same label.

Customers sometimes specify that more than one type of printing media be used for printed images or characters on a document. For example, it is sometimes desirable to print a black bar code image and a clear fluorescent image on the same label. To accomplish this, it has been generally necessary to first print the labels with one thermally transferable printing ribbon, for example, a visible black thermally transferable printing ribbon to print the black bar image using a thermal printer. Then, the same labels would be run through the thermal printer again with another thermally transferable printing ribbon, for example, a clear fluorescent security thermally transferable printing ribbon to print the clear fluorescent image onto the labels.

Accordingly, an object of the present invention is the provision of multi-layer thermally transferable printing ribbons and methods of making the same capable of printing different printing media onto paper or other print receiving media using a single thermally transferable printing ribbon.

Another object of the present invention is to provide multi-layer thermally transferable printing ribbons and methods of making the same capable of reducing the time necessary to print, for example, a black bar code image and a fluorescent security image, onto paper or other print receiving media by approximately 50%.

These and other objects of the present invention are attained by the provision of multi-layer thermally transferable printing ribbons and methods of making the same consisting of elongated backing elements having a subcoat layer requiring a relatively high level of thermal energy to transfer the subcoat layer and a topcoat layer which requires a lower level of thermal energy to transfer the topcoat layer. Accordingly, when printing using a lower level of thermal energy, only the topcoat layer will transfer onto the paper or other print receiving medium. On the other hand, if a relatively high level of thermal energy is used, both the topcoat layer and the subcoat layer will transfer onto the paper or other print receiving medium, with the subcoat layer remaining on top and blocking or obscuring the topcoat layer.

Other objects, advantages and novel features of the present invention will become apparent in the following detailed description of the invention when considered in conjunction with the accompanying drawings.

DETAILED DESCRIPTION OF THE DRAWINGS

Figure 1:
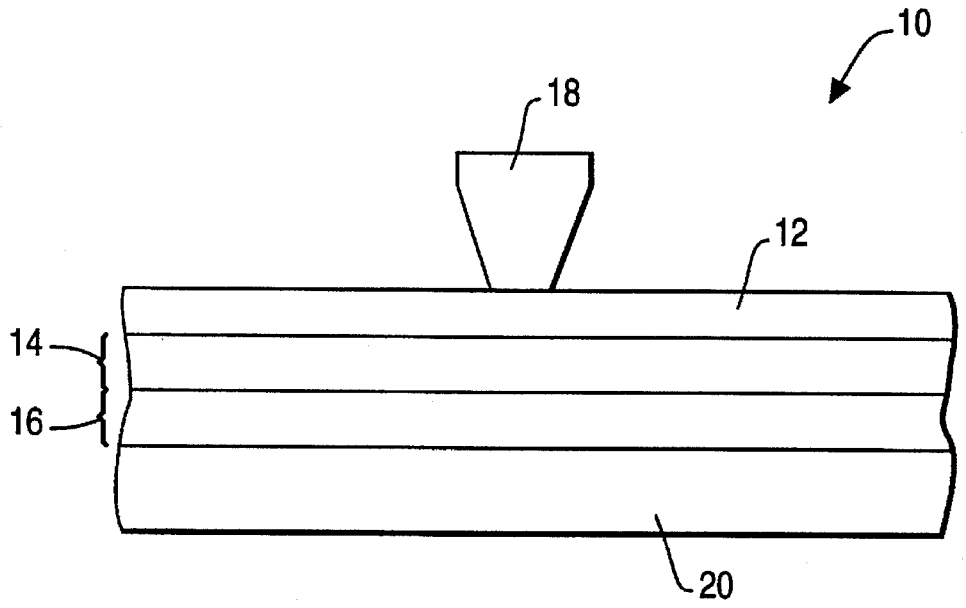
FIG. 1 is a cross-sectional side view of a preferred embodiment of a multi-layer thermally transferable printing ribbon showing a conventional thermal transfer print head transferring a thermally transferred printed image from the multi-layer thermally transferable printing ribbon to a print receiving medium in accordance with the present invention.
Figure 2:
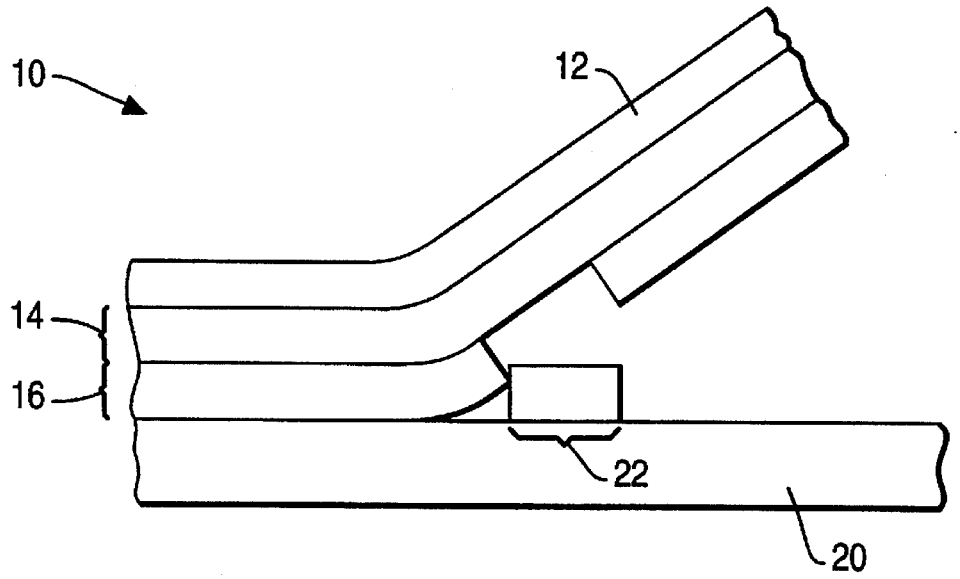
FIG. 2 is a cross-sectional side view of a preferred embodiment of a multi-layer thermally transferable printing ribbon showing a conventional thermal transfer print head transferring a thermally transferred printed image from the multi-layer thermally transferable printing ribbon to a print receiving medium in accordance with the present invention using a low level of thermal energy.
Figure 3:
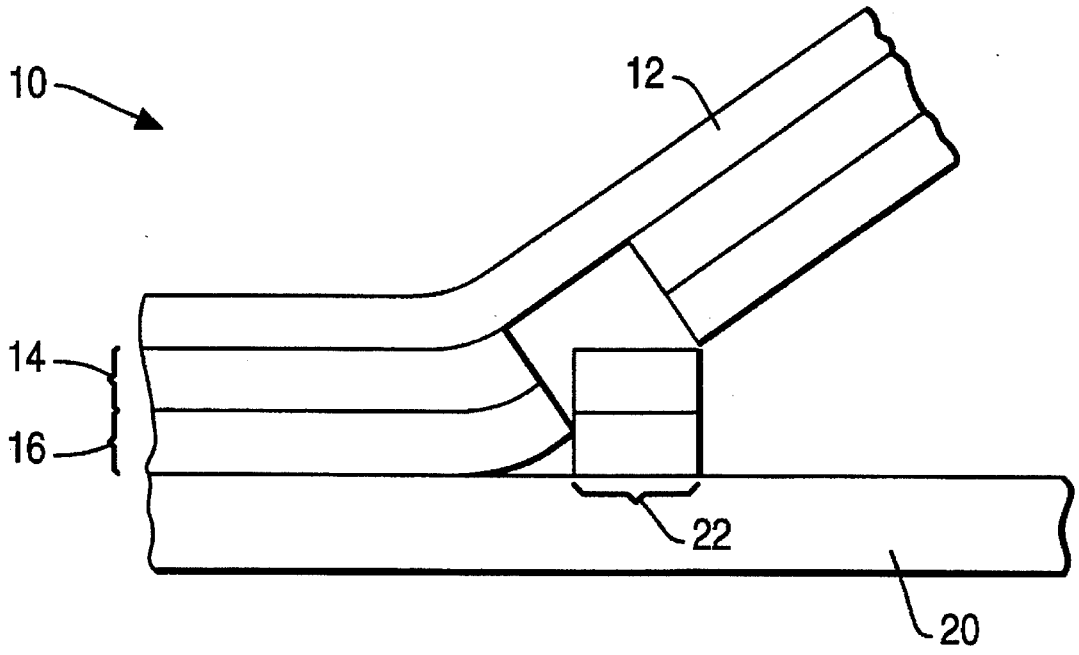
FIG. 3 is a cross-sectional side view of a preferred embodiment of a multi-layer thermally transferable printing ribbon showing a conventional thermal transfer print head transferring a thermally transferred printed image from the multi-layer thermally transferable printing ribbon to a print receiving medium in accordance with the present invention using a relatively high level of thermal energy.

Referring now to the drawings, in which like-referenced characters indicate corresponding elements throughout the several views, attention is drawn to FIGS. 1 through 3 which illustrate a first preferred embodiment of a multi-layer thermally transferable printing ribbon in accordance with the present invention, generally identified by reference numeral 10. Multi-layer thermally transferable printing ribbon 10 includes subcoat layer 14 adhered to one side of elongated backing element 12 and topcoat layer 16 adhered to subcoat layer 14 distal from elongated backing element 12. Elongated backing element 12 is preferably a long narrow strip of a flexible polymeric material, most preferably a polyester film such as Mylar, available from E. I. Dupont de Nemours & Co., Incorporated in Wilmington, Del. Elongated backing element 12 should be compatible with subcoat layer 14, and preferably has sufficient tensile strength to resist tearing, while being sufficiently flexible to be wound around a spool or reel.

In the preferred embodiment shown, subcoat layer 14 of thermally transferable printing ribbon 10 requires a relatively high level of thermal energy to transfer subcoat layer 14 onto paper or other printing receiving medium 20. On the other hand, topcoat layer 16 requires a lower level of thermal energy to transfer topcoat layer 16 onto paper of other print receiving medium 20. Therefore, when printing with lower levels of thermal energy, only topcoat layer 16 will transfer onto paper or other print receiving medium 20 and when printing with relatively high levels of thermal energy, both subcoat layer 14 and topcoat layer 16 will transfer to paper or other print receiving medium 20, with subcoat layer 14 now positioned on top of topcoat layer 16 and blocking or obscuring topcoat layer 16.

Topcoat layer 16 can include any color, for example, blue, red or clear fluorescent, but subcoat layer 14 should be black, or some other color sufficiently dark to block or obscure topcoat layer 16 when printed onto paper or other print receiving medium 20. For example, in accordance with a preferred embodiment of the present invention, a black "bullet-proof" coating is applied as subcoat layer 14 to elongated backing element 12. A clear fluorescent topcoat layer 16 is then applied to subcoat layer 14 on the surface of subcoat layer 14 distal from elongated backing element 12. The resulting multi-layer thermally transferable printing ribbon 10 allows a user to print a black bar code image using relatively high levels of thermal energy, as well as clear fluorescent security images, using the same multi-layer thermally transferable printing ribbon 10. As another example of a printing media combination for multi-layer thermally transferable printing ribbon 10, a black magnetic image character recognition (MICR) coating could be applied as subcoat layer 14 and a clear fluorescent coating could be applied as topcoat layer 16 to allow users to print black magnetic image character recognition (MICR) characters using relatively high levels of thermal energy, as well as clear fluorescent security images using relatively low levels of thermal energy, using the same multi-layer thermally transferable printing ribbon 10. As a final example of a printing media combination for multi-layer thermally transferable printing ribbon 10 to be given here, a dark blue coating could be applied as subcoat layer 14 and a medium red coating could be applied as topcoat layer 16 to allow users to print dark blue characters and images using relatively high levels of thermal energy, as well as medium red characters and images using relatively low levels of thermal energy, using the same multi-layer thermally transferable printing ribbon 10. It should be readily apparent to those having ordinary skill in the relevant art that many other combinations are envisioned and could be utilized by using the teaching of the present invention.

Table 1 below shows a preferred formulation for subcoat layer 14 in one preferred embodiment of multi-layer thermally transferable printing ribbon 10 as shown in FIGS. 1 through 3:

TABLE 1

| Subcoat Layer Formulation | | | | |
|---|---|---|---|---|
| Ingredient | % Dry Weight | % Dry Range | Grams Dry | Grams Wet |
| Isopropyl Alcohol | | | | 182.0 |
| Polyester Resin | 20 | 10–25% | 8.0 | 8.0 |
| Methacrylate-Terminated Polystyrene | 64 | 58–70% | 25.6 | 25.6 |
| Peroxide Initiator | 2 | 1–3% | 0.8 | 1.1 |
| Carbon Black | 14 | 10–20% | 5.6 | 5.6 |
| Total | 100.0 | | 40.0 | 222.3 |

In the above preferred formulation of subcoat layer 14 for multi-layer thermally transferable printing ribbon 10, the isopropyl alcohol used is marketed by Ashland Chemical in Cincinnati, Ohio; the polyester resin used is marketed as "K1717" by Lawter in Northbrook, Ill.; the methacrylate-terminated polystyrene used is marketed as "Methacromer PS 12" by PCI Specialty Polymer in State College, Pennsylvania; the peroxide initiator used is marketed as "Benzoyl Peroxide W 75" by Akzo Chemicals in Addison, Ill.; and the carbon black used is marketed as "Raven Beads" by Columban Chemicals in Atlanta, Ga. The backing element used is marketed as "4.5 micron Mylar Polyester Film" by E. I. Dupont de Nemours & Co., Incorporated in Wilmington, Del.

To prepare the formulation for subcoat layer 14 to coat on backing element 12, a subcoat layer wax mixture is made for subcoat layer 14 by dissolving the polyester resin and the methacrylate-terminated polystyrene in one half of the isopropyl alcohol and adding this mixture to an attritor. Then the peroxide initiator is dissolved in the remaining one half of the isopropyl alcohol and this mixture is added to the attritor. Carbon black is then added to the attritor and this mixture is ground in the attritor for approximately one hour to form the subcoat layer wax mixture for coating on backing element 12.

Table 2 below shows a preferred formulation for topcoat layer 16 in one preferred embodiment of multi-layer thermally transferable printing ribbon 10 as shown in FIGS. 1 through 3:

TABLE 2

| Topcoat Layer Formulation | | | | |
|---|---|---|---|---|
| Ingredient | % Dry Weight | % Dry Range | Grams Dry | Grams Wet |
| Mineral Spirits | | | | 300.0 |
| Ethylene/Vinyl Acetate/Acid Terpolymer | 9 | 5–10% | 9.0 | 9.0 |
| Hydrocarbon Resin | 9 | 5–10% | 9.0 | 9.0 |
| Vegetable Wax | 68 | 60–80% | 68.0 | 68.0 |
| Fluorescent Yellow Pigments | 14 | 10–20% | 14.0 | 14.0 |
| Total | 100.0 | | 100.0 | 400.0 |

In the above preferred formulation of smear and scratch resistant thermally transferable printing ribbon 10, the mineral spirits used is marketed by Ashland Chemical in Cincinnati, Ohio; the ethylene/vinyl acetate/acid terpolymer used is marketed as "Elvax 4310" by Dupont in Wilmington, Del.; the hydrocarbon resin used is marketed as "Wingtack 86" by Goodyear in Akron, Ohio; the vegetable wax used is marketed as "Candelilla Wax" by Strahl & Pitcsh in West Babylon, N.Y.; and the fluorescent yellow pigments used are marketed as "Lumogen Yellow S-0790" by BASF in Louisville, Ky.

To prepare the formulation for topcoat layer 16 to coat on the surface of subcoat layer 14 distal from backing element 12, a topcoat layer wax mixture is made for topcoat layer 16 by mixing the mineral spirits, the ethylene/vinyl acetate/acid terpolymer, the hydrocarbon resin and the vegetable wax at approximately 90° F. for approximately 30 minutes. The fluorescent yellow pigments are then added and the resultant wax mixture is ground in the attritor for approximately 90 minutes to form the topcoat layer wax mixture for coating on subcoat layer 14 distal from backing element 12.

To fabricate multi-layer thermally transferable printing ribbon 10, the sub coat layer wax mixture is coated onto elongated backing element 12 at a temperature of 160°–170° F. and a dry coat weight of 1.9±0.2 grams per square meter to form sub coat layer 14. In a subsequent operation, the topcoat layer mixture is coated on the surface of subcoat layer 16 distal from elongated backing element 14 at a temperature of 170°–180° F. and a dry coat weight of 1.9 ±0.2 grams per square meter to form finished multi-layer thermally transferable printing ribbon 10.

Referring again to FIGS. 1 through 3, the use of multi-layer thermally transferable printing ribbon 10 in the thermal transfer printing operation will now be described. As seen in FIG. 1, conventional thermal transfer print head, shown schematically as reference numeral 18, is placed in contact with elongated backing element 12 with topcoat layer 16 facing and in contact with print receiving medium 20, for example, paper. Portions of thermal transfer print head 18 corresponding to the desired thermally transferred printed image or character 22 are then heated, typically by passing an electrical current through selective resistive elements. As seen in FIG. 2, for a low level of thermal energy printing operation, this heating is continued until the temperature of topcoat layer 16 is above its melting point in those portions corresponding to the desired thermally transferred printed image or character 22, but not above the melting point of subcoat layer 14. The melted portions of topcoat layer 16 are then transferred onto the adjacent surface of print receiving medium 20, where topcoat layer 16 again solidifies. Referring now to FIG. 3, for a high level of thermal energy printing operation, the heating of thermal transfer print head 18 is continued until the temperature of subcoat layer 16 is above its melting point in those portions corresponding to the desired thermally transferred printed image or character 22. The melted portions of subcoat layer 14 and topcoat layer 16 are then transferred onto the adjacent surface of print receiving medium 20, where subcoat layer 14 and topcoat layer 16 again solidify on print receiving medium 20. In both of the above cases, once thermally transferred printed character or image 22 has solidified on print receiving medium, thermal transfer print head 18 is moved away and elongated backing element 14 is pulled away and separates from thermally transferred printed character or image 22. At this time, thermally transferred printed character or image 22 is fixed on print receiving medium 20.

When multi-layer thermally transferable printing ribbon 10 is used in its low level of thermal energy mode, only topcoat layer 16 transfers onto print receiving medium 20 as shown in FIG. 2, forming printed character or image 22 which is, in this example, a clear fluorescent security character or image. On the other hand, when multi-layer thermally transferable printing ribbon 10 is used in its high level of thermal energy mode, both subcoat layer 14 and topcoat layer 16 are transferred onto print receiving medium 20 with subcoat layer 14 positioned over, and blocking or obscuring, topcoat layer 16, forming printed character or image 22 which is, in this example, a visible black character or image, such as a bar code image. Thus, by controlling the level of thermal energy in a thermal printer, clear fluorescent security characters and images, as well as visible black characters and images, can be printed using a single multi-layer thermally transferable printing ribbon 10.

Although the present invention has been described above in detail, the same is by way of illustration and example only and is not to be taken as a limitation on the present invention. For example, although the use of thermally transferable printing media 12 having two layers has been described herein, the use of three, or more, layers could be readily accomplished utilizing the teachings of the present invention. Accordingly, the scope and content of the present invention are to be defined only by the terms of the appended claims.

What is claimed is:

1. A multi-layer thermally transferable printing ribbon, comprising:

a backing element having a top surface;

a subcoat layer adhered to said top surface of said backing element, said subcoat layer including 10 to 25% polyester resin, 58 to 70% methacrylate-terminated polystyrene, 1 to 3% peroxide initiator and 10 to 20% carbon black; and a topcoat layer adhered to said top surface of said subcoat layer, said topcoat layer including 5 to 10% ethylene/vinyl acetate/acid terpolymer, 5 to 10% hydrocarbon resin, 60 to 80% vegetable wax and 10 to 20% fluorescent yellow pigments.

2. The multi-layer thermally transferable printing ribbon in accordance with claim 1, wherein said subcoat includes approximately 20% polyester resin, approximately 64% methacrylate-terminated polystyrene, approximately 2% peroxide initiator and approximately 14% carbon black.

3. The multi-layer thermally transferable printing ribbon in accordance with claim 2, wherein said topcoat layer includes approximately 9% ethylene/vinyl acetate/acid terpolymer, approximately 9% hydrocarbon resin, approximately 68% vegetable wax and approximately 14% fluorescent yellow pigments.

4. The multi-layer thermally transferable printing ribbon in accordance with claim 3, wherein said backing element is fabricated from an elongated polymeric material.

5. The multi-layer thermally transferable printing ribbon in accordance with claim 1, wherein said topcoat layer includes approximately 9% ethylene/vinyl acetate/acid terpolymer, approximately 9% hydrocarbon resin, approximately 68% vegetable wax and approximately 14% fluorescent yellow pigments.

6. The multi-layer thermally transferable printing ribbon in accordance with claim 1, wherein said backing element is fabricated from an elongated polymeric material.

* * * * *